United States Patent [19]

Porter

[11] 4,005,810

[45] Feb. 1, 1977

[54] CONTINUOUS LIBRARY CATALOG CARD

[76] Inventor: Virgil V. Porter, 95-255 Hoeu Place, Mililani, Hawaii 96789

[22] Filed: Mar. 8, 1976

[21] Appl. No.: 664,980

Related U.S. Application Data

[63] Continuation-in-part of Ser. No. 326,063, Jan. 23, 1973, abandoned.

[52] U.S. Cl. ..... 226/6; 226/76; 197/133 P

[51] Int. Cl.[2] ..... B65H 17/38

[58] Field of Search ..... 226/6, 76, 80–87, 226/39, 195; 346/136; 197/133 P

[56] References Cited

UNITED STATES PATENTS

| | | | |
|---|---|---|---|
| 2,452,591 | 11/1948 | Metzner | 226/87 |
| 3,310,636 | 3/1967 | D'Arcy | 226/76 X |

*Primary Examiner*—Richard A. Schacher
*Attorney, Agent, or Firm*—Harris Zimmerman

[57] ABSTRACT

A continuous web for library catalogue cards having a plurality of slit lines longitudinally spaced 7.5 centimeters apart, each slit line extending 12.5 centimeters transversely between edge carrier portions of the form such that upon removal of the carrier portions outwardly of the slit lines a plurality of standard 7.5 centimeters × 12.5 centimeters catalogue cards are provided. Longitudinally extending lines of uniquely shaped feed holes or perforations are provided in the carrier portions of the form which permit printing of the cards by means of existing high speed printers of United States manufacture despite the cards being dimensioned in the metric system and the feed of the printers being dimensioned in the English system.

4 Claims, 4 Drawing Figures

FIG_1
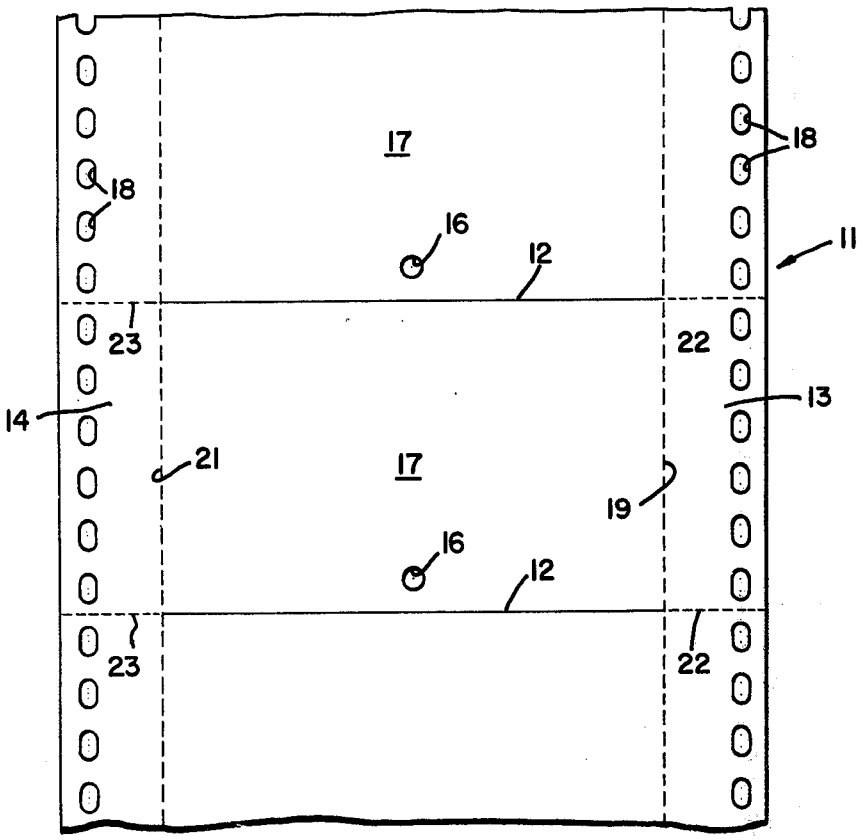
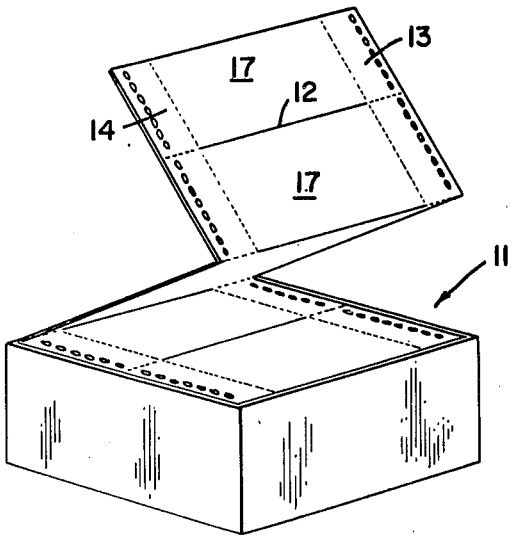
FIG_2

CONTINUOUS LIBRARY CATALOG CARD

REFERENCE TO PRIOR APPLICATION

The instant application is a Continuation-In-Part of my previous application for United States Letters Patent, Ser. No. 326,063, filed on Jan. 23, 1973, and now abandoned.

BACKGROUND OF THE INVENTION

It has been estimated that the annual usage of library catalogue cards is on the order of 4,000,000,000. Because of this substantial volume of cards, there has been increasing pressure towards producing cards at high speed by computer printing. However, the international standard for library catalogue cards has been established in the metric system of dimensions as 7.5 centimeters by 12.5 centimeters. Such metric dimensions of the card pose problems in their computer printing on high speed printers of United States manufacture which are typically arranged to feed or space by dimensions in the English system. In other words, the card dimensions are not readily compatible to high speed printing in the United States.

Heretofore the unique size of the catalogue cards has resulted in a variety of ways to achieve the appropriate outsize through the use of forms manufactured in inches. In accordance with one method, a form has been provided in a 3½ inch or 3 inch card depth to facilitate printing on substantially any United States high speed printer in a conventional manner. Subsequent to printing, the form is die cut in an area between the cards to force the 7.5 centimeter size. In other words, if the card depth is 3 inches, the die cut is such as to remove 0.12 centimeters of material and thereby leave a 7.5 centimeter dimension.

Another method is to use a 3½ inch depth which may be burst into single cards subsequent to printing. Thereafter the cards are trimmed on a guillotine cutter to the correct size.

Because of the foregoing approaches to the production of catalogue cards, these cards are expensive in manufacture and expensive in use.

SUMMARY OF THE INVENTION

The present invention relates to a continuous library catalogue card form having slit lines directly defining a 7.5 centimeter card depth, which is yet arranged to permit running of the form on any high speed printer of United States manufacture to provide printed standard 7.5 centimeters by 12.5 centimeters cards in a direct manner not involving expensive precision cutting or trimming techniques to arrive at the card dimension.

In the accomplishment of the foregoing and other advantages and features, a continuous form in accordance with the present invention is generally provided with a plurality of slit lines longitudinally spaced 7.5 centimeters apart, each line transversely extending 12.5 centimeters between longitudinally extending edge carrier portions of the form. Within the carrier portions there are provided longitudinally extending lines of elongate feed holes or perforations on a 1.25 centimeters center to center which permit continuous feeding of the forms by all high speed printers of United States manufacture, the standard feed drives of which have ½ inch centers. Such perforations are usually referred to in the business forms field as "feed holes", "line holes", or "line hole punching". In one embodiment, the form is provided with longitudinally extending perforate separation lines intersecting the opposite ends of the slit lines to facilitate the ready removal of the carrier portions of the form, whereby the individual printed 7.5 centimeters by 12.5 centimeters cards remain. In another embodiment, the perforate separation lines are omitted and a detacher or burster in line with the printer slits off the carrier portions of the form.

THE DRAWING

FIG. 1 is a fragmentary plan view of a continuous library catalog form in accordance with the present invention.

FIG. 2 is a perspective view of the form in accordion folded stacked condition preparatory to introduction to a high speed printer.

DETAILED DESCRIPTION OF THE INVENTION

Figures 3, 4:
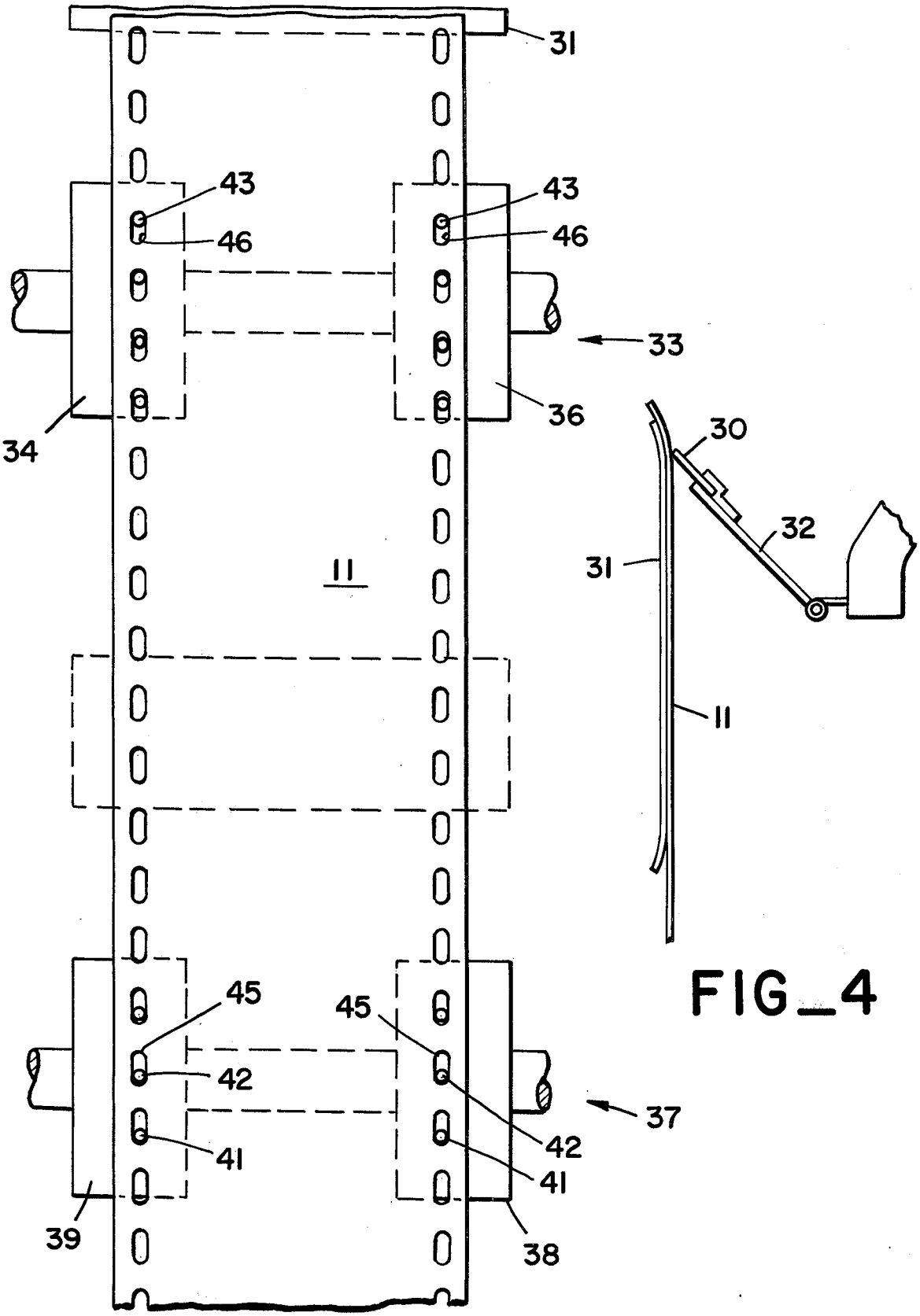
FIG. 3 is a plan view of a form according to the present invention being fed through a typical high speed printer of English dimensions.
FIG. 4 is a side view of a typical acoustical dampener used in a conventional high speed printer.

Referring now to FIG. 1 in detail, there is shown a continuous library catalogue form 11 of heavy paper, or equivalent material, having a plurality of slit lines 12 extending transversely or widthwise of the form, such lines being longitudinally spaced apart by 7.5 centimeters. The slit lines are 12.5 centimeters in length and are disposed centrally of the transverse dimension of the form with their opposite ends terminating at longitudinally extending edge carrier portions 13 and 14. Each carrier portion preferably has a width of 2.5 centimeters such that the overall width of the form is 17.5 centimeters. In addition, holes 16 are provided forwardly adjacent the midpoints of the slit lines. Such holes are preferably of 5/16 inch diameter. Each area between adjacent slit lines and between the carrier portions defines a standard 7.5 centimeters by 12.5 centimeters library catalogue card 17 having a hole 16 to facilitate retention in a card file, or the like, by means of a retaining rod, etc.

By virtue of the metric dimensions of the cards 17, the computer programming printing of the cards by means of high speed printers of United States manufacture has posed problems, since such printers are arranged to feed or space in dimensions in the English system rather than in the metric system. More particularly, standard form feeding tractors of United States high speed printers are on half-inch centers using ⅛ inch pins. Such tractors are generally employed to engage feed perforations of a continuous form which are correspondingly spaced apart center to center by English system dimensions such as ½ inch. The English system dimensional spacing of the feed perforations cannot be arranged for symmetrical disposition with respect to the metric system dimensions of the card; that is, unsymmetrical printing thereof would normally result if high speed printers of United States manufacture are employed.

In accordance with the particularly salient aspects of the present invention, the foregoing problems of high speed printing of the form 11 by printers of United States manufacture are overcome despite the card defining slit lines 12 being spaced apart in dimensions in the metric system. In this regard, the carrier portions 13 and 14 of the form 11 are provided with longitudinal lines of feed perforations 18 of unique spacing and shape. The perforations have a center to center longitudinal spacing of 1.25 centimeters and are of elongate rectangular configuration, preferably 5/16 inch long by 5/32 inch wide with rounded ends. The longitudinal center lines of the perforations are preferably spaced transversely inward from the side edges of the form by ¼ inch. The perforations are symmetrically disposed with respect to the sides of the cards 17, there being six perforations between adjacent slit lines 12 with the end ones of the perforations equally spaced from the respective slit lines.

It will be thus appreciated that although the center to center spacing between the perforations 18 is slightly less than ½ inch, the elongate configuration of the perforations enables some to be engaged by the ⅛ inch pins on ½ inch centers of standard feed tractors of any United States manufactured high speed printer. Such a printer runs and spaces the form 11 as if it were 3 inches in depth rather than the 7.5 centimeter depth between slit lines. This results in a 24 line capacity for each card 17.

To facilitate removal of the carrier portions 13 and 14, and thus separation of the cards 17 subsequent to printing, the form may be provided with longitudinally extending perforate separation lines 19 and 21 intersecting the opposite ends of slit lines 12 to thereby define boundaries between the carrier portions and the cards. In addition, perforate separation lines 22 and 23 may be provided to extend transversely from the opposite ends of each slit line 12 to the side edges of the form. Thus, the carrier portions may be readily removed at the separation lines to thereby free the individual printed cards 17. The transverse separation lines 22 and 23, moreover, facilitate the ready accordion folding of the form into the stacked configuration shown in FIG. 2, which is particularly well suited to loading into some high speed printers.

As an alternative to the means hereinbefore described to facilitate separation of the cards 17, the separation lines may be omitted and the form 11 run over a detacher, burster, slitter, or the line in line with the printer to slit off the carrier portions 13 and 14.

It should be understood that while this invention has been described in connection with one specific continuous product, i.e., library catalogue cards, the inventive concept may likewise be applied to other continuous forms wherein the forms have metric dimensions, but are adapted to be run on printers made on the English dimension system. In such cases, the transversely extending separation lines would usually comprise perforations rather than the slit lines 12, such perforations being aligned with the perforate lines 22, 23 on the longitudinally extending carrier portions.

The method of feeding the forms punched according to the present invention through an English dimensioned high speed printing press may best be described with reference to FIGS. 3 and 4. The form web 11 passes over a paper entry guide 31, where it is engaged by an acoustical dampener 32. The acoustical dampener comprises a brush 30 impinging on the web 11 under spring force to create a frictional drag on the web, and prevent an acoustical shock wave from travelling down the web and disrupting the web flow. These dampening devices are well known in the art, and are commonly used in high speed printers, such as the IBM Model 1403 printer.

The forms shown in the sketch are marginally punched with elongated holes as described above on 1.25 centimeter centers. As the forms enter the printing area of the press they first encounter the infeed tractor 33, which comprises a pair of pin wheels 34 and 36 mounted on a common shaft, the right hand wheel 34 being laterally adjustable so that the press can accommodate forms of varying width. Both of these wheels are driven. They serve the purpose of driving the paper web into the print area, holding it flat as it reaches the line printer. The left hand wheel 36 also operates a runout switch which turns off the printer when the paper runs out.

The forms then are printed by the line printer in the print area, and subsequently are engaged by the outfeed tractor 37. The outfeed tractor includes another pair of pin wheels 38 and 39, and the right hand wheel 39 is also laterally adjustable. These tractors are driven by a motor through a chain drive, and they draw the forms through the machine. All of the pin wheels are the ones considered to be standard in the industry, with 3/16 inch long pins having distal end spacings of ½ inch.

In the situation depicted in FIG. 3, the leading pins 41 of the outfeed tractor 37 are about to disengage from the form which is being presented to the line printer. The subsequent feed pins 42 of the outfeed tractors must travel 0.07874 inches before engaging the leading edges of the subsequent holes 45 in the form. During this interval there is no positive drive on the form.

At the same time as the pins A are disengaged, the pins 43 of the infeed tractors 33 are engaging the trailing edges of the holes 46 in the web. None of the infeed pins are engaging the leading edges of their respective holes, and no drive is exerted on the form by either tractor 33 or 37. Due to the drag of the acoustical dampener (which helps stabilize the paper web), the form actually halts for a brief instant, approximately 0.0823 seconds at a printing rate of 1100 lines per minute, and a feed rate of 6 lines per inch. The form does not "coast" through the printer, but actually does stop. This is evidenced by the fact that in the experimental runs the printout was evenly spaced, and that on a 27.5 centimeter form, 66 lines were printed at six lines per inch. The next feed pin 42 then engages the leading edge of hole 45, and the form accelerates once more.

It must be emphasized that high speed line printers will not perform the method of the present invention when used in conjunction with standard forms which are provided with standard circular marginal holes which are spaced on ½ inch centers. The pins will then engage the holes with exact registration, the form will pass smoothly through the printer, and the method will not be practised. Thus the form of the present invention is its own program, causing a standard line printer to practice the claimed method and achieve the printing of a metric form on a conventional English dimension press.

The present invention will also apply to slow speed printers such as the IBM System 3, which prints at a rate of 100 to 200 lines per minute. These machines employ an outfeed tractor to draw the forms through the printer, and replace the infeed tractors with a curved mandrel over which the forms pass on their route from a packing carton on the floor to the printing and outfeed mechanisms. In this case the gravitational load of the forms depending from the one engaged by the outfeed tractor is sufficient to cause the form to stop momentarily while the next outfeed pin approaches the leading edge of the subsequent marginal hole.

There are other frictional devices commonly employed in line printers which exert the drag on the web required to stop the web momentarily as it is fed through the printer. For example, some printers employ an electromagnetic acoustical dampener which includes a pair of spaced plates through which the web is drawn by the tractors. The plates are actuated momentarily and periodically to grip the web, stopping it and blocking the passage of an acoustical wave down the web. In other printers the forms thickness control exerts a drag on the web which is sufficient to cause the feed sequence described in the foregoing to occur. Thus the method of feeding the forms punched according to the present invention as described herein may be practised on a wide variety of line printing machines.

It should be emphasized that the form punching as detailed in the present invention not only provides a means of running metrically dimensioned forms on English dimensioned printers, but also this same manner of punching renders the form acceptable to metrically dimentioned printers having feed pins spaced on 1.25 centimeter centers.

I claim:

1. The method of feeding a continuous web, marginally punched, metrically dimensioned form on a machine having an endless array of driven feed pins with a ½ inch spacing between pins, comprising the steps of: engaging the feed pins with a form having at least one margin with feed perforations having a center-to-center spacing of 1.25 centimeters, with the perforations being elongated in the longitudinal direction of feed to provide a longitudinal perforation dimension substantially greater than the transverse perforation dimension; engaging one perforation driving edge with one feed pin; driving the one feed pin and thereby the continuous length web material in the driving direction; thereafter releasing the one feed pin from its driving engagement with the one perforation driving edge; thereafter moving the feed pins approximately 0.02 centimeters while simultaneously holding said continuous web stationary; thereafter engaging the next feed pin with the corresponding next feed perforation driving edge and advancing said next feed pin and continuous length web approximately 1.25 centimeters; and thereafter indefinitely repeating the above three preceding steps for successive feed pins and feed perforations.

2. The method of claim 1, including the step of providing said elongated perforations as rectangles 5/16 inch long and 5/32 inch wide with rounded ends and providing said feed pins with a diameter within said perforations of ⅛ inch.

3. The method of feeding a continuous web, marginally punched, metrically dimensioned form on a machine having an endless array of driven feed pins with a one-half inch spacing between pins, comprising the steps of: providing a form having at least one margin with spaced feed perforations, the perforations being elongated in the longitudinal direction of feed to provide a longitudinal perforation dimension substantially greater than the transverse perforation dimension and substantially greater than the pin longitudinal dimension; engaging one perforation driving edge with one feed pin; driving the one feed pin and thereby the continuous length web material in the driving direction; thereafter releasing the one feed pin from its driving engagement with the one perforation driving edge; thereafter moving the feed pins to engage the next feed pin with the corresponding next feed perforation driving edge while simultaneously holding continuous web stationary; thereafter advancing said next feed pin and continuous length web; and thereafter indefinitely repeating the above three preceding steps for successive pin feeds and feed perforations.

4. The method of claim 3, including the step of providing said elongated perforations with a longitudinal, center-to-center spacing of 1.25 centimeters.

* * * * *